United States Patent [19]

Wibom

[11] 3,980,145

[45] Sept. 14, 1976

[54] METHOD AND APPARATUS FOR INSERTING TUBULAR STRUCTURAL MEMBERS IN A SOIL FORMATION

[76] Inventor: Gustaf Håkan Oskar Wibom, Skogsvagen 12, 181 41 Lidingo, Sweden

[22] Filed: Oct. 9, 1974

[21] Appl. No.: 513,384

[30] Foreign Application Priority Data

Oct. 19, 1973 Sweden ..... 7314236

[52] U.S. Cl. ..... 175/65; 175/170; 175/173; 61/41 R

[51] Int. Cl.[2] ..... E21B 3/02

[58] Field of Search ..... 61/41 R, 41 A, 63, 42, 61/40; 175/135, 162, 170, 381, 171; 299/31, 58

[56] References Cited

UNITED STATES PATENTS

| | | | |
|---|---|---|---|
| 428,021 | 5/1890 | Rothwell | 61/41 R X |
| 560,267 | 5/1896 | Kite | 175/381 X |
| 887,952 | 5/1908 | Milligan | 61/41 R X |
| 1,907,854 | 5/1933 | Moran | 61/41 R |
| 3,017,708 | 1/1962 | Gardner | 175/170 X |
| 3,017,709 | 1/1962 | Sigler | 175/170 X |
| 3,453,832 | 7/1969 | Rehmar | 61/41 R X |
| 3,779,322 | 12/1973 | Stevens | 61/41 R X |
| 3,826,317 | 7/1974 | Pereau | 175/162 |

FOREIGN PATENTS OR APPLICATIONS

| | | | |
|---|---|---|---|
| 526,927 | 3/1954 | Belgium | 61/41 R |
| 338,017 | 8/1971 | Sweden | 61/41 R |

*Primary Examiner*—Dennis L. Taylor
*Attorney, Agent, or Firm*—Stanley D. Schwartz

[57] ABSTRACT

A tubular structural member is inserted in a ground or soil formation by drilling the formation ahead of a cutting edge on the member proper and bringing the member to perform a combined rotary and axial movement so that the cutting edge is driven into the drilled zone. An apparatus for practicing the method comprises a drilling machine having a feed device, a cutting edge at one end of the structural member and a means for rotating and axially displacing the member.

17 Claims, 13 Drawing Figures

METHOD AND APPARATUS FOR INSERTING TUBULAR STRUCTURAL MEMBERS IN A SOIL FORMATION

This invention relates to a method and an apparatus for inserting a tubular structural member, such as a casing tube for concreting, in a soil formation which may contain rock.

Prior methods and apparatuses for this purpose are described for instance in German Pat. No. 697,025, German open-to-public-publication 1,484,415, U.S. Pat. No. 1,907,854 and Swedish lay-open-print 338,017. None of these prior methods and apparatuses is, however, sufficiently effective, particularly if the structural member is to be inserted in a rocky formation.

The method according to the invention comprises the steps of drilling the formation ahead of a cutting edge on the tubular structural member, and bringing the structural member to perform a combined rotary and axial movement so that the cutting edge is driven into the drilled zone.

The method enables large structural members to be sunk comparatively easily to the desired depth, even in rocky terrain. The tubular member itself thus acts as a kind of drill, but with the soil prepared beforehand by drilling possibly with a percussion rock drill.

Renewed drilling and driving-in of the cutting edge can be carried out in stages and/or the drill can possibly be rotated as the cutting edge is being driven into the drilled zone, so that the structural member is inserted in a more or less continuous operation.

In practice, guiding or steering the drill at the lower end of the lining or mantle surface of the structural member is preferred. The drill can either be passed through at least the lower end of the said lining surface, or else be steered on the inside of the structural member, in which case it should have a drill bit with its outer periphery at least coinciding with that of the structural member and preferably, to some extent, extending beyond it.

The invention can be used to sink structural members to the desired depth, particularly through non-cohesive soils and rock, where great difficulties used to be experienced in sinking cylindrical structural members, especially ones more than 300 mm in diameter. The invention can, however, also be applied for inserting structural members obliquely or horizontally in a soil formation, for instance through road embankments and when tunnelling shields are used.

When using the method the drill can be withdrawn to a position of rest before the structural member is driven in. The shoulder-type cutting edge then gives the optimum effect.

In one embodiment of the invention, a feed beam is used which, with the drilling rod for the drill as an intermediate connection while the structural member is being driven in, performs a combined rotary and axial motion in relation to the structural member.

This enables the feed beam always to have the same principal alignment while the structural member is rotating, thereby avoiding coiling of the jetting hoses, which supply sluicing-jets to the drill bit or to the shoulder-type cutting edge, around the feed beam or around the structural member while it is turning or rotating.

The invention also relates to an apparatus for inserting a tubular structural member — for instance a casing tube for concreting — in a soil formation by application of the procedure described above. The arrangement includes a drilling machine with a feeding device, the structural member having mounted on it at one end a cutting edge in the form of a shoulder in the zone ahead of which the drill is steered, a means for turning the structural member and displacing it axially also being provided. It is preferred that the drill steering means be fitted within or in the area of the lower lining surface of the structural member.

In one embodiment, the drilling machine is mounted on a feed beam at the opposite end relative to the cutting edge of the structural member.

The feed beam can be mounted directly on the lining surface of the structural member, so that it accompanies the latter during its axial driving movement.

In one embodiment, however, the feed beam is connected to a revolving and axially displaceable telescopic shaft and also to the inside lining of the structural member via a sleeve through which the drill or a drilling rod belonging to the drilling machine is passed.

Further aspects of the invention will be evident from the description of some embodiments thereof given below. The description is made in connection with the accompanying drawings.

Figure 9:
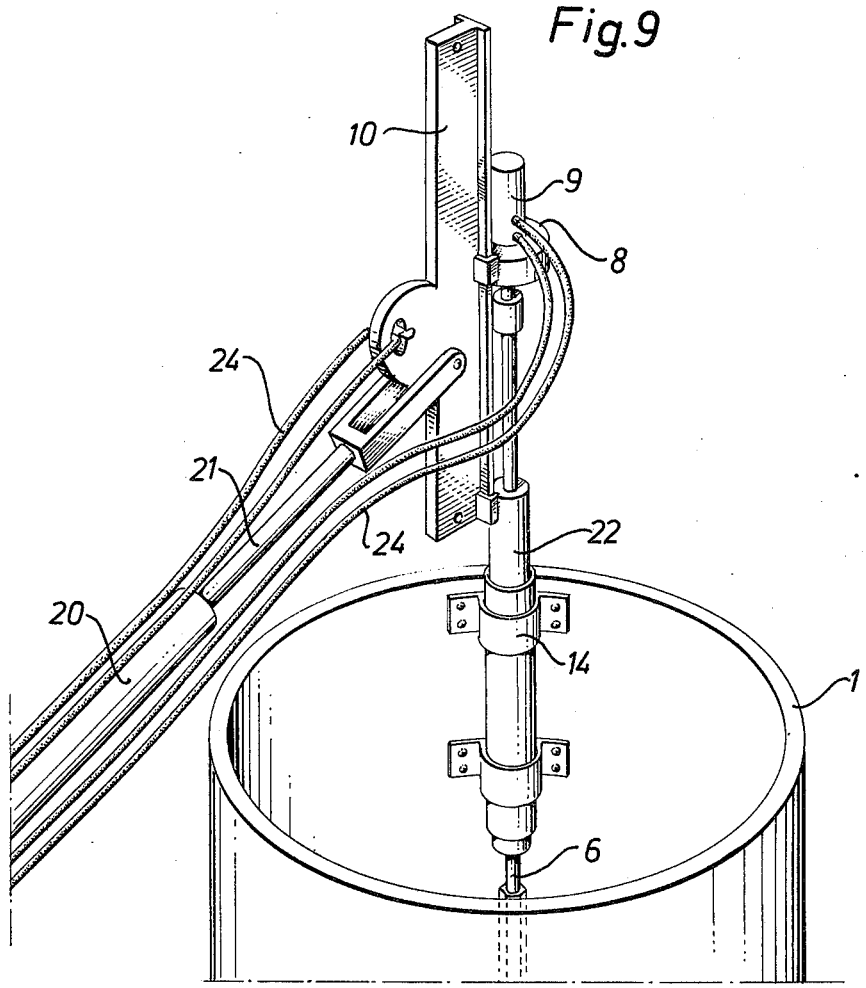
FIG. 9 is a perspective view which illustrates an arrangement for interaction between a feed beam, the drilling device and the structural member.
Figure 9A:
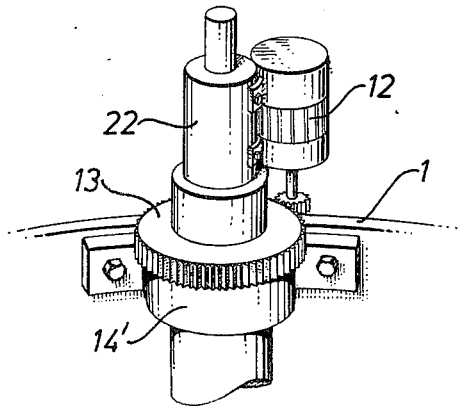

FIG. 9*a* illustrates a modification of part of the FIG. 9 arrangement.

Figure 10:
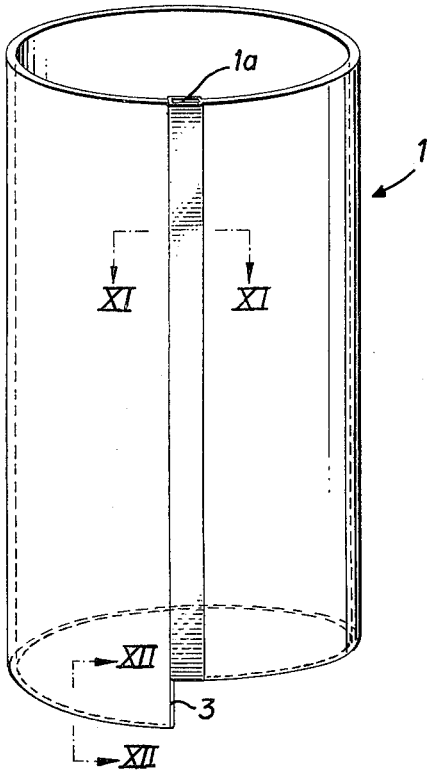

FIG. 10 is a perspective view of a structural member for use when the method according to the invention is applied.

Figure 11:
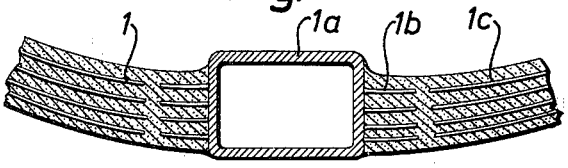

FIG. 11 is a section along the line XI—XI in FIG. 10.

Figure 12:
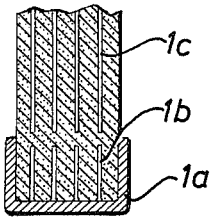

FIG. 12 is a section along the line XII–XII in FIG. 10.

Figure 1:
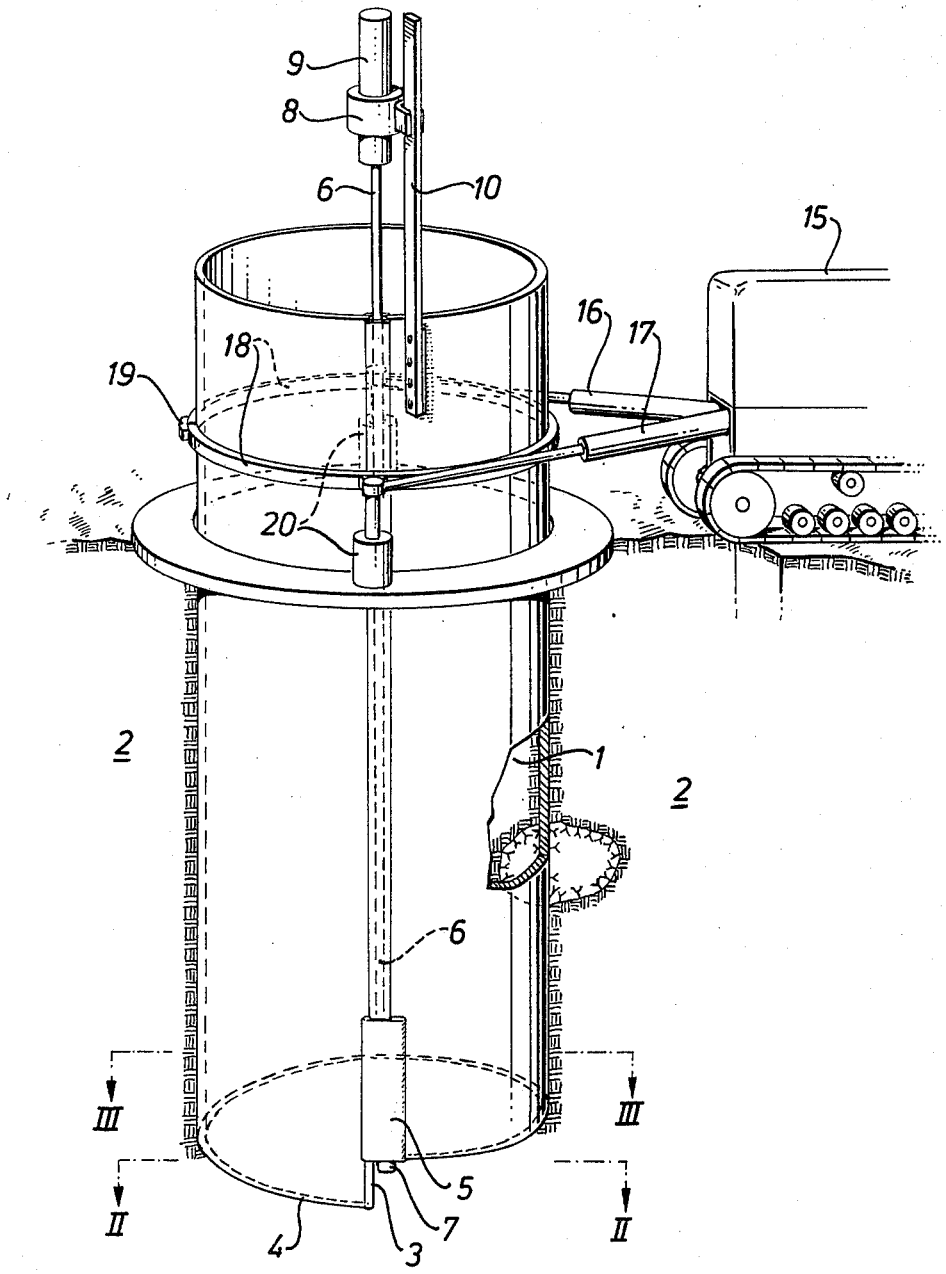
FIG. 1 is a perspective view illustrating schematically the fundamental process for driving a structural member into a ground or soil formation, using an apparatus according to the invention.

Referring to FIG. 1, 1 denotes a structural member in the form of a tube — for instance a casing tube for concreting — which is to be inserted in a ground or soil formation 2. The tube 1, which can be of any desired diameter and thickness, has at its bottom edge one or more cutting edges 3, in the form of a shoulder. The bottom edge 4 of the tube is in the form of a helix, the pitch of which equals the height of the shoulder-type cutting edge 3.

In the zone in front of the shoulder-type cutting edge there is a guide or steering means 5 for a drilling rod 6 which has a drill bit 7 at its lower end.

The drilling rod can be part of a basically conventional percussion rock drill, the top of which is subjected to the percussive action, or, alternatively, a sinker drill can be used. The drilling machine is controlled with the aid of a feed beam 10, which in the embodiment shown in FIG. 1 is mounted at the lining surface of the structural member 1.

To enable the structural member 1 to be rotated, a rotating device is used comprising an excavator 15 which carries two hydraulic cylinders 16, 17 and which works in conjunction with a clamping device 18, 19, which grips the structural member 1. The hydraulic cylinders 16, 17 and the clamping device 18, 19 can be made to move vertically with the aid of two jacks 20, which can also be used for drawing up or forcing down the structural member 1.

The drilling arrangement also includes a means of supplying drilling or jetting liquid — not shown in FIG. 1 — to the zone ahead of the drill bit 7 and the shoulder-type cutting edge 3 on the structural member 1.

The structural member is driven into a soil formation in the following manner:

When the structural member has been set up on the proposed site and fitted with the necessary equipment, it is rotated by means of the hydraulic cylinders 16, 17 until an obstruction — for instance a rock — prevents further rotation. The drilling machine is then started and the drill bit 7 is fed down, with drilling or jetting liquid supplied at the same time, until whatever has obstructed the rotation of the structural member has been jetted out and washed away by the liquid. The drill bit can then be drawn up to an upper position recessed in the guide 5, whereupon the structural member is rotated and at the same time advanced axially, causing the cutting edge 3 to work itself down into the drilled zone of soil. The structural member is rotated through a distance equal to the drill-bit diameter or until the shoulder-type cutting edge meets another obstruction, whereupon drilling and driving of the cutting edge 3 into the drilled zone again take place in stages. In some soil formations the drill can rotate while the cutting edge is being driven in, which takes place more or less continuously until an obstruction is encountered, enabling the structural member to be driven into the soil formation at a rate corresponding to the resistance of the soil to the driving motion. For lighter soils, the drill can be helical in shape.

Simultaneously with the driving of the structural member, mucking can — if necessary — be carried out inside the member. Excavated portions of the soil formation can be removed while the structural member is being driven in. There are no difficulties in this respect, since the positioning of the drilling machine allows almost unlimited access to the area confined by the structural member.

If desired, the structural member can have several shoulder-type cutting edges together with the corresponding drilling machines and possibly appurtenant drill bits. For driving in the structural member it is then sufficient in many cases to have a reciprocating rotary motion combined with axial advancement. It is possible also to have several drilling machines connected to one and the same feed beam.

A possible alternative is to build the structural member in two or more sections, one section bearing a cutting edge being movable in relation to the upper part of the structural member.

If the structural member has been driven in to the extent that its top edge is near the surface of the ground, the structural member and the drilling rod 6 can be joined together and driving is then continued. When the bottom edge of the structural member has reached the desired level drilling is stopped whereupon the inside of the member can be cleaned out completely, after which the desired reinforcement can be inserted in the structural member, followed by pouring of the concrete, where applicable. If necessary, the structural member is then removed before the concrete has set completely.

Figure 2:
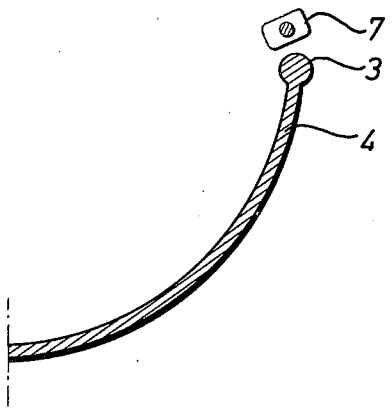
FIG. 2 is a cross-section along the line II—II in FIG. 1.
Figure 3:
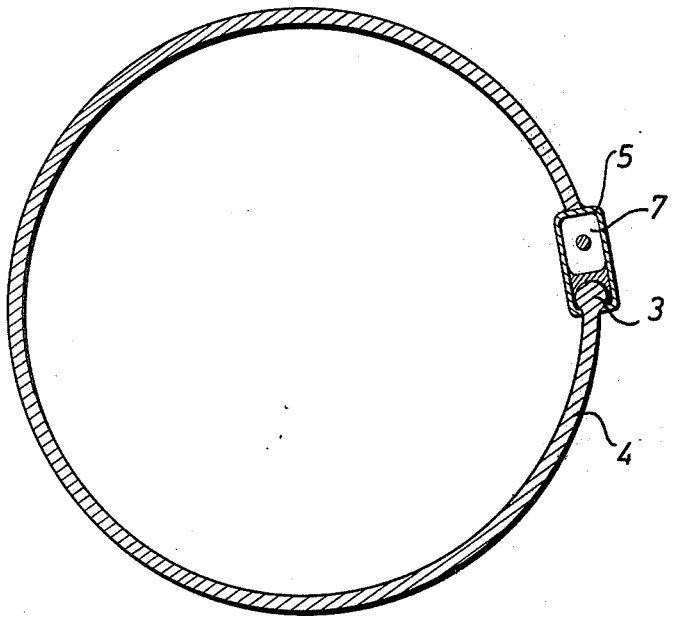
FIG. 3 is a cross-section along the line III—III in FIG. 1.

The cross-section shown in FIGS. 2 and 3 illustrates the design of the shoulder-type cutting edge 3, drill head 7 and guide 5. The structural member can consist of a reinforced concrete tube and the guide 5 can be a steel tube embedded in the lower part of the tube wall.

Figure 4:
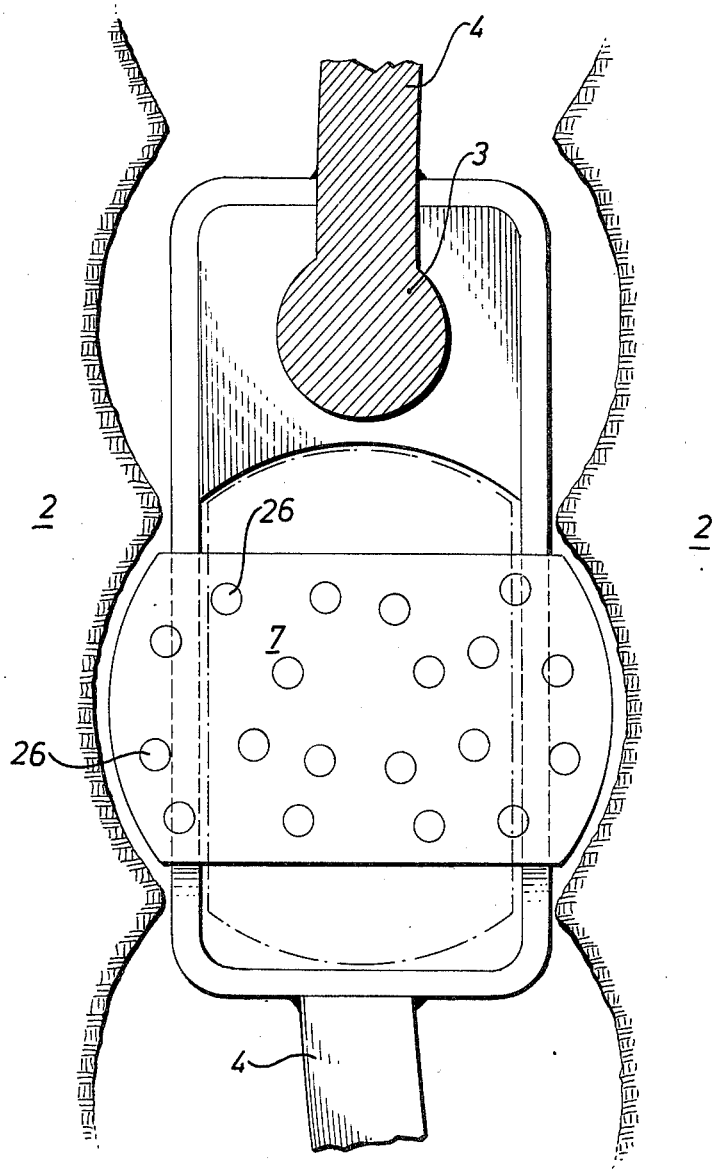
FIG. 4 is a view from below of the drill bit and the steering means for the drilling rod.

FIG. 4 shows, on a larger scale, the drill head 7 and its guide. The drill head has pins 26 inserted in it.

Figure 5:
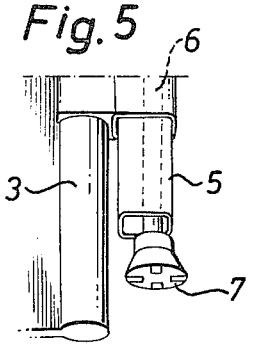
FIG. 5 is a perspective view which illustrates a cutting edge in the form of a shoulder on the lower part of the structural member, together with the drilling rod and the appurtenant steering means.

FIG. 5 shows that the drill head 7 and the guide 5 which encloses the drilling rod 6, can be withdrawn to a position of rest ahead of the upper part of the cutting edge 3. Such withdrawal is carried out in some cases before the cutting edge 3 is driven into the drilled zone after drilling.

Figure 6:
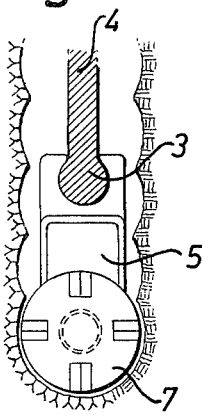
FIG. 6 is a view from below of the components illustrated in FIG. 5.
Figure 7:
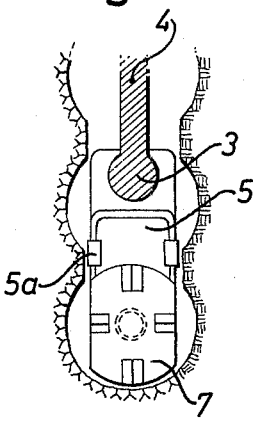
FIG. 7 is a modification of the components shown in FIG. 6.

FIGS. 6 and 7 show the arrangement as in FIG. 5 seen from below. It illustrates, in particular, the configuration of the soil when the structural member is driven into it. FIG. 7 shows an embodiment in which the guide 5 is fitted with means **5*a*** to chisel away certain parts of the soil formation left after drilling.

Figure 8:
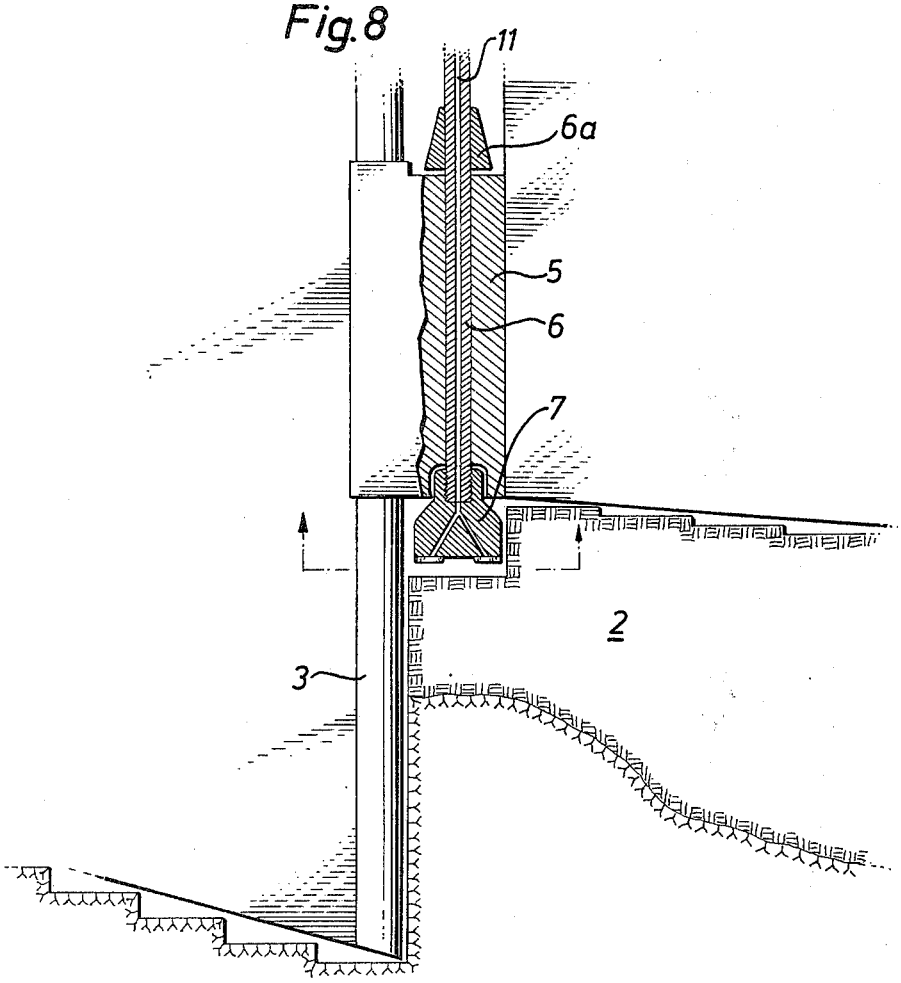
FIG. 8 is a cross-section through the lower part of the structural member fitted with a modified steering means for a drill bit.

In FIG. 8 the drilling rod 6 is shown fitted with a driver **6*a*, which actuates the drilling-rod guide 5. This figure also shows a cavity 11** in the drilling rod and drill head for supplying drilling or jetting liquid to the drilled zone.

In FIG. 9 the upper part of the structural member 1 is shown. In this embodiment the drilling machine 8, 9 is mounted on a feed beam 10 connected to a telescopic arm 20, 21. The arm 20, 21 pivots both vertically and horizontally. The feed beam 10 is connected via a sleeve 22 to the inside wall of the structural member 1, in relation to which the sleeve 22 can be rotated. Two yokes 14 rotatably secure the sleeve 22 to the inside wall. The arrangement allows the structural member to be rotated while the feed beam 10 is always in the same direction. This prevents the jetting hoses 24 from being coiled up on the feed beam 10 or on the structural member 1 while the latter is being rotated.

FIG. **9*a* illustrates a modification of part of the FIG. 9 embodiment. The sleeve 22 carries a small hydraulic motor 12 having a drive gear engaging a gear 13 on the structural member 1. A yoke 14' is connected to the gear (ring) 13. Then the telescopic arm 20, 21 shown in FIG. 9** can be dismissed.

FIG. 10 is a perspective view of a modified tubular structural member 1. The structural member can consist of a reinforced concrete tube, like the one described above. A steel tube **1*a* bedded in the wall of the tube extends vertically upwards from the shoulder-type cutting edge 3. Welded to this steel tube is an anchorage 1*b* for a reinforcement 1*c*. The arrangement is also illustrated in FIG. 11**.

I claim:

1. A method of inserting a tubular structural member such as a casing tube for concreting in a ground or soil formation which may contain rock comprising the steps of:

drilling the formation at a position circumferentially ahead of a circumferential cutting edge provided on the tubular structural member so as to dislodge and/or disintegrate any rock which may be disposed within said formation and thereby facilitate cutting of said formation by said cutting edge, and causing the structural member to perform a combined rotary and axial movement so that the circumferential cutting edge is driven into the drilled zone disposed circumferentially ahead of said cutting edge.

2. A method according to claim 1, wherein: said cutting edge is formed as an axially extending shoulder on the structural member.

3. A method according to claim 1 further comprising the step of:

performing renewed drilling and driving-in of the cutting edge in a stepwise manner until the structural member has reached the desired position in the ground.

4. A method according to claim 3, further comprising the step of rotating the drill while driving in the cutting edge.

5. A method according to claim 1, further comprising the step of guiding the drill at the lower end of the casing of the structural member.

6. A method according to claim 5, further comprising the step of withdrawing the drill to a position of rest before driving the cutting edge into the drilled zone.

7. A method according to claim 1, further comprising the step of supporting the drill by means of a feed beam mounted at the end opposite the cutting edge of the structural member.

8. A method according to claim 7, further comprising the step of bringing the feed beam while using the drilling rod as an intermediate connection when driving in the structural member to perform a combined crank and axial motion in relation to the structural member.

9. An apparatus for inserting a tubular structural member such as a casing tube for concreting, in a soil formation, said apparatus comprising:

drilling means for drilling said formation so as to dislodge and/or disintegrate rock-like material disposed within said formation and provided with a feed device for feeding said drilling means, a circumferential cutting edge provided at one end of said structural member, said drilling means being secured upon said structural member at a position circumferentially ahead of said cutting edge so as to drill the section of said formation which is disposed circumferentially ahead of the formation section being cut by said cutting edge thereby facilitate the cutting of said formation by said cutting edge, guide means for guiding said drilling means in the region of said cutting edge, and means for rotating and axially displacing the structural member and said cutting edge into said drilled section of said formation.

10. An apparatus as claimed in claim 9, wherein:

said cutting edge is formed as an axially extending shoulder on the structural member.

11. An apparatus according to claim 10, wherein the guide means for the drill is mounted in or near the lining surface of the structural member.

12. An apparatus according to claim 10, wherein the drilling means is mounted on a feed beam at the opposite end of the structural member relative to the cutting edge.

13. An apparatus according to claim 12, wherein the feed beam is connected to a pivotable, axially movable telescopic shaft and also, via a sleeve through which the drill or a drilling rod belonging to the drilling means passes, to the inside lining of the structural member.

14. An apparatus according to claim 9, further comprising means for jetting the drill and/or the shoulder-type cutting edge.

15. An apparatus according to claim 9, wherein the end of the structural member having the cutting edge takes the form of at least part of a helix.

16. An apparatus according to claim 9, wherein the structural member has several cutting edges in the form of a shoulder, each of which cooperates with a separate drill.

17. An apparatus for inserting a tubular structural member, such as a casing tube for concreting in a soil formation, said apparatus comprising:

drilling means for drilling said formation so as to dislodge and/or disintegrate rock-like material disposed within said formation and provided with a feed device for feeding said drilling means, a circumferential cutting edge provided at one end of said structural member, said drilling means being secured upon said structural member at a position circumferentially ahead of said cutting edge so as to drill the section of said formation which is disposed circumferentially ahead of the formation section being cut by said cutting edge and thereby facilitate the cutting of said formation by said cutting edge, and means for rotating and axially displacing the structural member and said cutting edge into said drilled section of said formation.

* * * * *